US005832853A

United States Patent [19]

Pokrishevsky et al.

[11] Patent Number: 5,832,853

[45] Date of Patent: Nov. 10, 1998

[54] CAP EMBROIDERY APPARATUS AND METHOD

[75] Inventors: Alexander D. Pokrishevsky, Aurora; Vladimir A. Birjulin, Denver; Gary G. Steffenson, Littleton, all of Colo.

[73] Assignee: Melco Industries, Inc., Denver, Colo.

[21] Appl. No.: 807,134

[22] Filed: Feb. 27, 1997

[51] Int. Cl.[6] ..... D05C 9/04

[52] U.S. Cl. ..... 112/475.11; 112/103

[58] Field of Search ..... 112/475.04, 475.11, 112/103, 102.5, 470.06, 470.14, 470.17, 470.29, 305, 308, 309, 470.09, 10, 63

[56] References Cited

U.S. PATENT DOCUMENTS

| | | | |
|---|---|---|---|
| 4,628,843 | 12/1986 | Tajima | 112/121.11 |
| 4,665,844 | 5/1987 | Shibata | 112/470.29 X |
| 4,998,964 | 3/1991 | Golia | 112/103 X |
| 5,167,194 | 12/1992 | Nakagaki | 112/103 |
| 5,261,338 | 11/1993 | Tajima et al. | 112/103 |
| 5,415,116 | 5/1995 | Nishio | 112/103 |
| 5,507,241 | 4/1996 | Evans | 112/740 |
| 5,553,560 | 9/1996 | Tajima et al. | 112/103 |
| 5,598,797 | 2/1997 | Patterson | 112/103 |
| 5,649,496 | 7/1997 | Morita et al. | 112/103 |

*Primary Examiner*—Peter Nerbun
*Attorney, Agent, or Firm*—Sheridan Ross P.C.

[57] ABSTRACT

A tensioning assembly for applying tension to portions of a cap is provided. The tensioning assembly increases the tension applied to cylindrical sections of the cap that are located between the cap visor and the back of the cap. The tensioning assembly includes a tensioning disk that is moveable inwardly and outwardly, as well as being rotatable, when an embroidery pattern is being stitched on the cap. The tensioning assembly is connected to a drive apparatus and its position relative thereto can be adjusted, depending upon the size of the cap. A cable adjustment assembly is also preferably included for maintaining desired tension of a cable that is coupled to a drive beam used in providing linear motion that is translated to rotational movement of the cap being embroidered. A holder assembly is connected to the drive apparatus for maintaining desired positioning of the drive beam particularly when the drive apparatus is detached from the computerized embroidery machine.

14 Claims, 9 Drawing Sheets

CAP EMBROIDERY APPARATUS AND METHOD

FIELD OF THE INVENTION

The present invention relates to stitching a fabric using a computerized machine and, in particular, embroidering a cap while applying tension to the cap.

BACKGROUND OF THE INVENTION

The stitching of patterns on fabrics using computer controlled sewing machines has become a standard practice in the industry. Computerized embroidering on fabrics is also well-established. Fabrics that can be embroidered assume a variety of shapes and sizes. One of these is caps, where the fabric for embroidering includes the cylindrical-shaped body of the cap. Frames and other assemblies have been devised for use with caps to facilitate the embroidering process. It is common to embroider the front of the cap body with emblems, logos, letters and the like. During the embroidering process, this part of the cap is relatively stiff or rigid so that a quality embroidered pattern is readily achieved using current devices. Typically, the cap is releasably held to a cap frame that is connected to a rotatable unit that rotates under the control of the computerized embroidery machine. This configuration or arrangement of parts allows for the pattern to be properly stitched on the front of the cap. However, present cap embroidery equipment is not particularly well-suited for providing embroidery along substantial portions of the cap body, where these portions of the cap are more flexible and less rigid. Such a characteristic of the cap at these cap body sections tends to create problems in creating high quality embroidery. That is, it is more difficult to accurately stitch the desired pattern when the fabric at these portions is not rigid, but has small or minute undulations along these portions of the cap body.

It would be advantageous, therefore, to enhance the quality of the embroidered pattern along the body of the cap, particularly between the front and back of the cap. This can be accomplished by applying additional tension to the cap fabric to increase the tension at these sections of the cap body. Preferably, it would be advantageous to essentially modify existing embroidery hardware in a relatively straightforward way to achieve the desired tension without loss or reduction in other features associated with embroidering caps.

SUMMARY OF THE INVENTION

In accordance with the present invention, method and apparatus are provided for changing the tension that is applied to certain parts of fabric to be stitched, such as cylindrical sections of a cap body on which a pattern is stitched. The apparatus includes a tensioning assembly that applies increased tension to sections of the cap body. The cap body is the generally cylindrical portion of the cap, which also includes a visor connected to the front of the cap body and a crown located at the top of the cap body. The sections of the cap body that benefit from the increased tension are located between the front of the cap and the back of the cap.

The tensioning assembly includes a moveable or rotatable tensioning disk, which engages the cap at its crown. The tensioning disk is also moveable inwardly and outwardly against a disk spring. When the cap initially engages the tensioning disk, there is typically an inward movement of the tensioning disk against the force of the disk spring. Then, the tensioning disk is moved outwardly in the opposite direction due to the spring force, which thereby produces desired tension. This tension at the crown of the cap results in greater rigidity or stiffness in these sections of the cap. The tensioning assembly also includes a bracket to which a number of adjusting rods are held. The bracket is adjacent to one end of the disk spring, with the other end of the disk spring adjacent to the tensioning disk. In addition to being moveable inwardly/outwardly, the tensioning disk is also rotatable about an axis through its center. As the cap is rotated during the stitching of the pattern, the tensioning disk is able to rotate with it. Each of the adjusting rods, at its end opposite the end connected to the bracket, has a locking nut that is fastened to the adjusting rod. The locking nuts are used in adjusting the tensioning assembly. In particular, these ends of the adjusting rods are received by a drive apparatus, which is used in rotating the cap. Depending on the size of the cap and the desired tension to be achieved, the adjusting rods are positioned relative to the drive apparatus and held in place using the locking nuts. When the size of the cap, for example, changes, the locking nuts can be unlocked to permit the adjusting rods to be moved and thereby also move the tensioning disk relative to the drive apparatus.

With regard to the drive apparatus, it comprises a number of parts including a bar or drive beam having a groove formed in its bottom surface. A cable or wire is connected to the drive beam and is located in the groove. The drive apparatus also includes a rotatable cylinder drive that is coupled to the drive beam by means of the cable. The cable is wrapped around the cylinder drive and is attached to or held in a channel formed in the cylinder drive. When the bar or drive beam is driven longitudinally in a direction along its length (X direction), the cable moves and causes the drive cylinder to rotate. The drive beam is also moveable in a lateral direction (Y direction) that is normal to the longitudinal direction. By means of these two movements, including simultaneous movement in the X and Y directions, a desired pattern can be stitched or embroidered on the cap or other fabric. That is, when the drive beam is moved longitudinally, for example, the cap and the tensioning disk are caused to rotate a desired distance for alignment with a vertically movable, thread-carrying needle that moves into the fabric and stitches it.

With respect to causing the longitudinal and/or lateral movement of the drive beam, the drive beam is connected to a carriage assembly by means of a tongue or attachment members. The carriage assembly is part of the computerized stitching or embroidery machine. As is well known, the carriage assembly is able to move in X and Y directions under computer control, based on the desired pattern to be embroidered on the cap or other fabric.

The cap is joined to the drive apparatus by a cap frame assembly. The cap frame assembly includes a frame body and a visor holding member that is pivotal to releasably hold the cap visor in place. The visor holding member includes a slot for receiving the visor of the cap. Once the cap is properly secured to the cap frame body, the cap frame assembly is then attached to the drive apparatus at the cylinder drive. Consequently, when the cylinder drive rotates, the cap frame assembly together with the cap, rotate as well. In connection with key aspects involved in the operation for embroidering the cap body, the tensioning disk is suitably positioned relative to the drive apparatus by the adjustment previously described in which the adjusting rods are properly disposed relative to the drive apparatus. With the cap secured to the cap frame assembly, the cap frame assembly is positioned over the tensioning disk and moved toward the cylinder drive of the drive apparatus. In doing so, the tensioning disk is typically moved inwardly against the force of the disk spring and then moves outwardly to engage the cap at its crown and thereby provide the desired tension. Subsequently, embroidering of the cap can begin.

The drive apparatus also includes a cable adjustment assembly for adjusting the tension of the cable used in rotating the cap in predetermined directions and steps. Over long periods of usage, the cable tends to lengthen or "stretch" whereby inaccuracies can be introduced related to the position of the cap. That is, under computer control, the cable moves to thereby move the cap. If the length of the cable changes, cable movement associated with a particular computer command may not be same as a previous cable movement (before tension changed due to cable "stretching") for the same computer command (X and/or Y directional movement). Consequently, the cap might move a distance that is not accurate for providing the desired pattern. Very slight variations in this tension can lead to a less than high quality embroidery. The cable adjustment assembly is used in maintaining the same tension by use of the force of a cable spring. The cable spring is pretensioned and positioned relative to ends of the cable to enable the tension of the cable to remain the same or virtually the same.

A holder assembly is also connected to the drive apparatus for facilitating the holding or the maintaining of position of the drive beam relative to the drive apparatus, particularly when the tongue is detached from the carriage assembly. Without the holder assembly, when the drive apparatus is detached from the carriage assembly, the drive beam that is coupled to the circular channel of the cylinder drive using the cable is likely to undesirably move or "flop" relative to the cylinder drive. The holder assembly includes a bracket that is connected to the drive apparatus, together with a L-shaped clip that is joined to the lateral leg of the bracket. The clip holds the drive beam during relative movement between the holder assembly and the cylinder drive to maintain a desired straight position between the drive beam and the cylinder drive.

Based on the foregoing summary, a number of key aspects of the present invention are readily identified. The present invention enhances the quality of the stitches or embroidery on fabric, particularly on the body of a cap. This is preferably achieved by applying tension to the cap at desired cap locations. The application of tension is accomplished using a tensioning assembly connected to a drive apparatus to which a cap frame is joined. The cap is secured to the cap frame. The tensioning assembly is adjustable relative to the drive apparatus, depending upon the size of the cap. The present invention also includes a cable adjustment assembly. This assembly increases tension in a cable as the cable tends to lengthen over time as a result of use. A holder assembly is also preferably provided as part of the invention that is useful in maintaining desired positioning of a drive beam relative to a drive cylinder. This holder assembly facilitates handling or carrying of the drive apparatus.

Additional advantages of the present invention will become readily apparent from the following discussion, particularly when taken together with the accompanying drawings.

DETAILED DESCRIPTION

Figure 1:
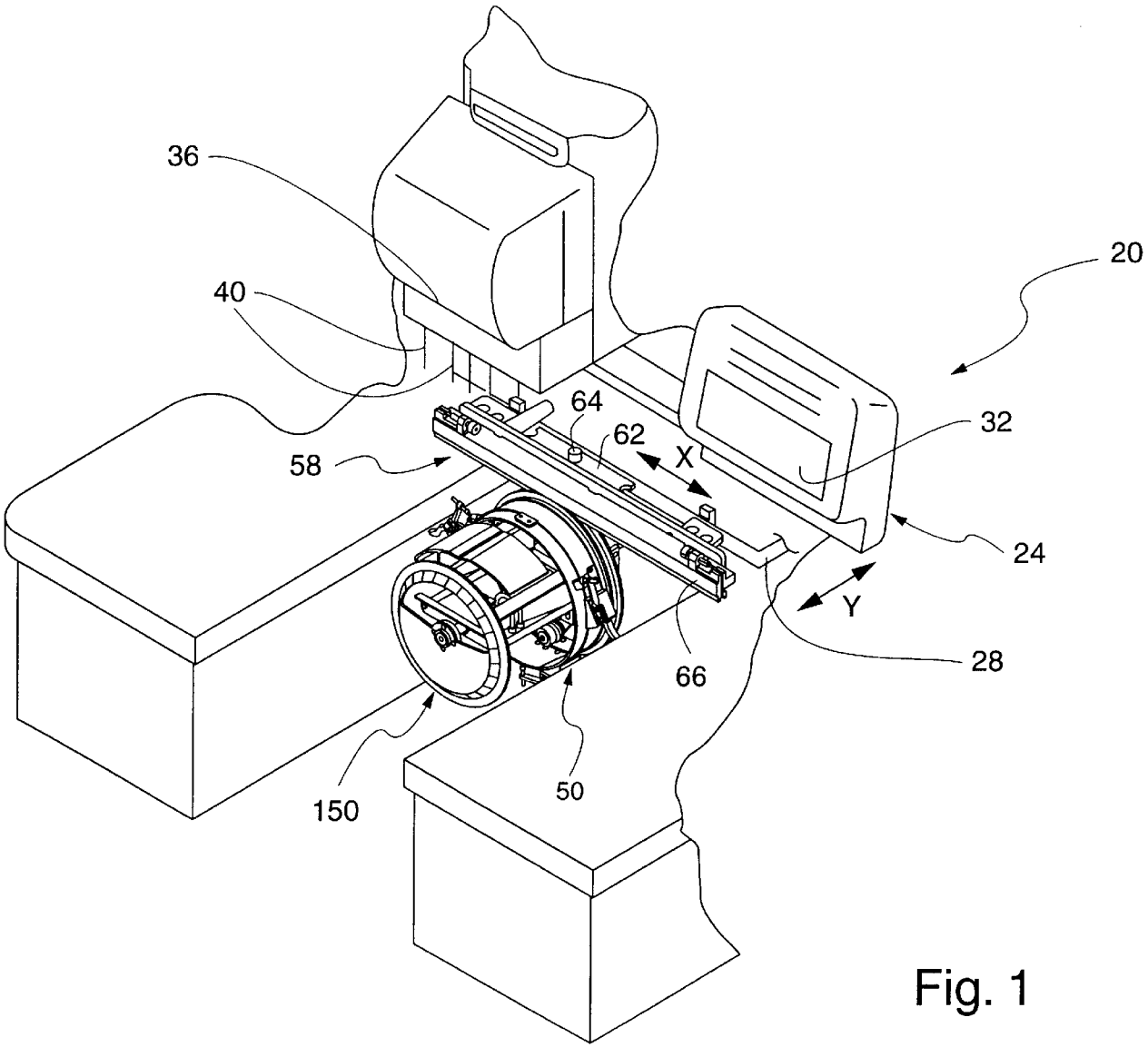
FIG. 1 is a perspective view of the invention schematically illustrating the tensioning assembly and the drive apparatus operatively connected to a computerized embroidery machine.

With reference to FIG. 1, a system 20 is disclosed for embroidering fabric, particularly a cap. The system 20 includes a computerized embroidery machine 24 having a carriage assembly 28. The computerized embroidery machine 24 is a conventional unit that includes all of the appropriate components and assemblies for computerized embroidery. These components and assemblies include, among other things, one or more processors, memory storage devices, input devices such as a keyboard and the diagrammatically illustrated display terminal 32. The computerized embroidery machine 24 also has a sewing head 36 having one or more needles 40. Each of the needles 40 might be used in stitching a different colored thread.

Figure 2:
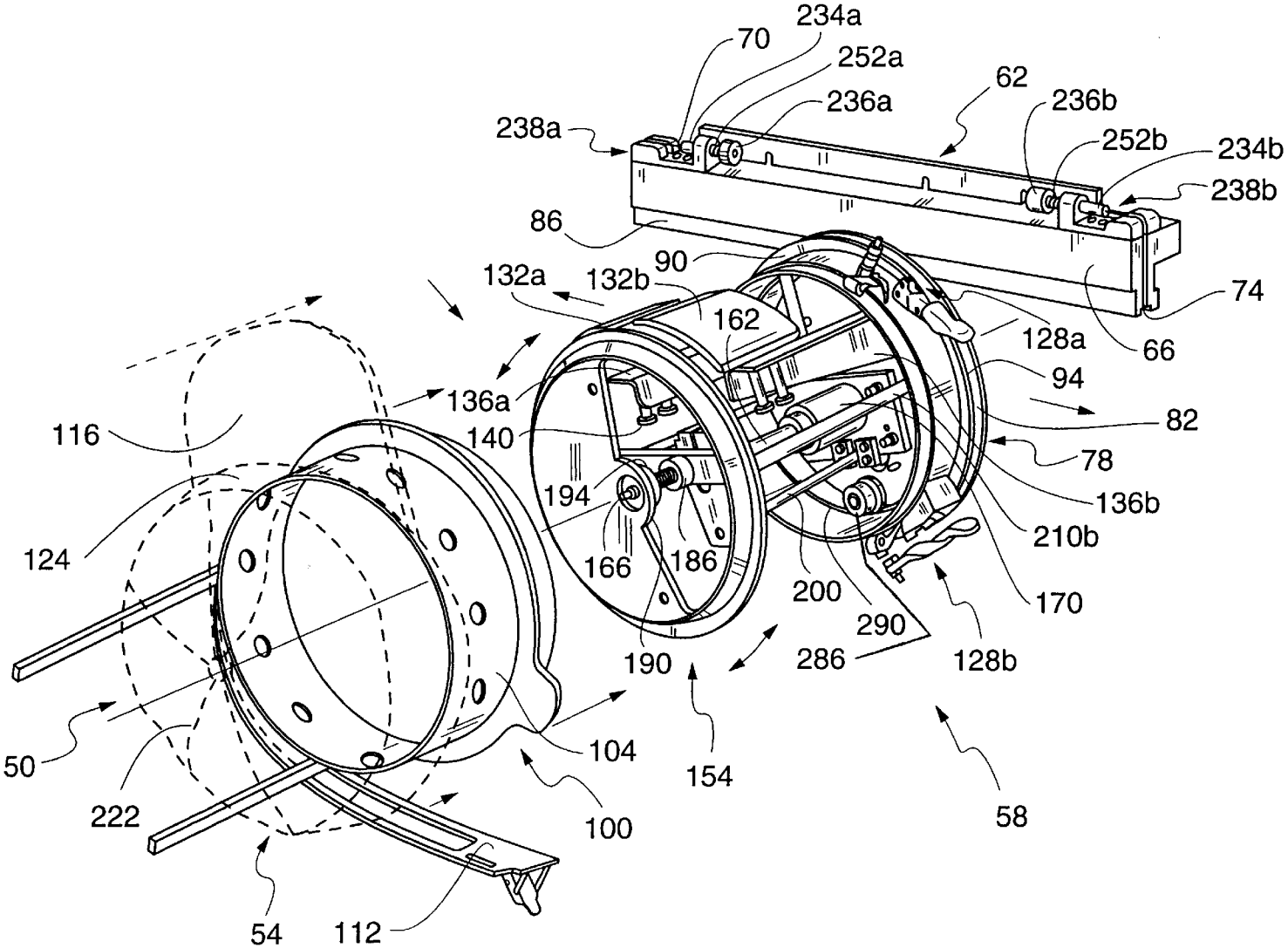
FIG. 2 is an exploded view illustrating the cap frame assembly to which a cap is securable and being aligned for positioning over the tensioning disk of the tensioning assembly for connection to the cylinder drive adjacent to the drive beam.

With reference to FIG. 2 as well as FIG. 1, a cap embroidery apparatus 50 is attached to the computerized embroidery machine 24 for use in stitching a pattern on a cap 54. The cap embroidery apparatus 50 includes a drive apparatus 58 that is connected or otherwise joined to the carriage assembly 28. In that regard, the drive apparatus 58 includes a bar or drive beam 66 that is connected to an attachment member 62. The attachment member 62 is joined to the movable carriage assembly 28 using one or more fasteners or pins 64. The drive beam 66 is moved in X and Y directions either separately or simultaneously in connection with the embroidery process, which will be discussed in more detail later herein. The X direction is parallel to the length or longitudinal extent of the drive beam 66. The Y direction is perpendicular to the length of the drive beam 66. Regarding such movement, the drive apparatus 58 further includes a cable or wire 70 extending from an upper face of the drive beam 66 and being disposed in a groove 74 formed in an insert or bottom section 86 of the drive beam 66 and with the cable 70 then extending about a drive cylinder 78.

Figure 6:
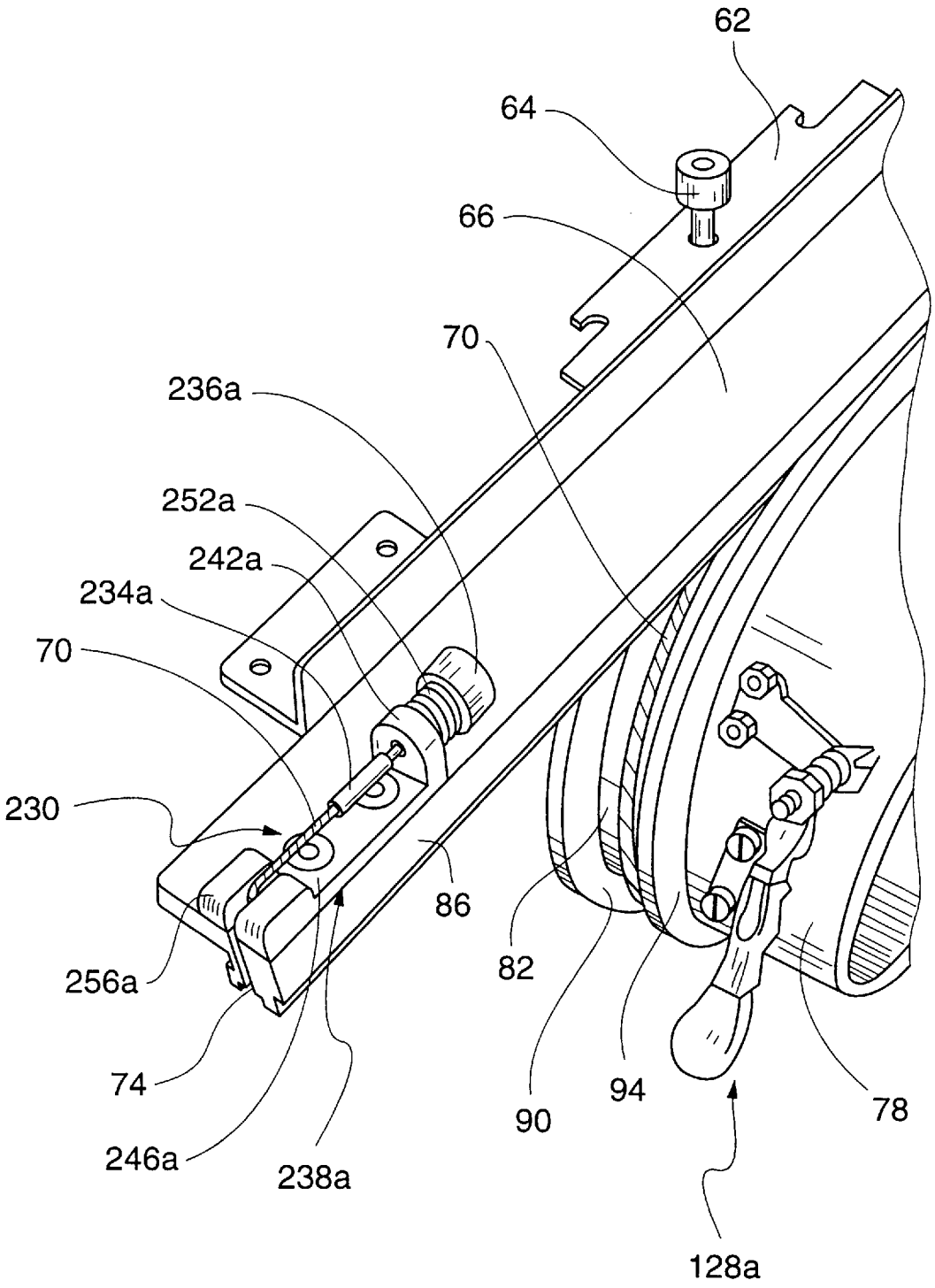
FIG. 6 is an enlarged, fragmentary perspective view illustrating portions of the cable adjustment assembly.

With reference to FIG. 6, the cable 70 is located and fixedly held in a channel 82 of the drive cylinder 78. Briefly, movement of the drive beam 66 in the X direction results in movement of the cable 70 that is positioned in the channel 82 to thereby rotate the drive cylinder 78. That is, the cable 70 extends from one end of the drive beam 66 along the groove 74 and exits the groove 74 to wrap around the drive cylinder 78 in the channel 82 thereof. The cable 70 exits the channel 82 to again be positioned in the groove 74 at the opposite end of the drive beam 66. The insert section 86 of the drive beam 66 is positionable in portions of the channel 82 that is defined between first and second flanges 90, 94 of the drive cylinder 78. Accordingly, movement of the drive beam 66 in the X direction, based on movement of the carriage assembly 28, causes the drive cylinder 78 to rotate due to the movement of the cable 70 attached to the drive cylinder 78 in its channel 82. Thus, the linear movement of the drive beam 66 is translated into rotational movement of the drive cylinder 78 using the cable 70.

With reference to FIG. 2, the cap embroidery apparatus 50 also includes a cap frame assembly 100 for holding or supporting the cap 54. The cap frame assembly 100 includes a cap frame body 104 and a pivotal band 108 that has a locking buckle 112. With respect to removably attaching the cap 54 to the cap frame assembly 100, the cap visor 116 is received within a slot 120 formed in the band 108. The cap body 124 is located around or outside of the cap frame body 104. With the cap 54 so placed relative to the cap frame assembly 100, the band 108 can be pivoted to a locking position and held in place using the locking buckle 112 to thereby hold the cap 54 to the cap frame assembly 100. With the cap 54 joined to the cap frame assembly 100, the cap frame assembly 100 is located over the cylinder drive 78 to be releasably attached thereto using a plurality of clamp assemblies 128*a*, 128*b*. The clamp assemblies 128*a*, 128*b* engage the cap frame body 104 and hold the cap 54 to the outer face of the drive cylinder 78. Accordingly, rotational movement of the drive cylinder 78 results in rotational movement of the cap frame assembly 100 and the accompanying cap 54.

Support and some rigidity for the cap body 124 is provided by support members 132*a*, 132*b* that are spaced from the drive cylinder 78 and the drive beam 66. The support members 132*a*, 132*b* contact the cap body 124 when the cap frame assembly 100 is connected to the drive cylinder 78. Spacing of the support members 132*a*, 132*b* from the drive cylinder 78 is accomplished using brackets 136*a*, 136*b*. The support members 132*a*, 132*b* are connected to the brackets 136*a*, 136*b* using fasteners 140. The fasteners 140 are adjustably located along the length of the brackets 136*a*, 136*b* so that the spacing of the support members 132*a*, 132*b* relative to the drive cylinder 78 can be varied depending upon the height of the cap body 124. That is, minor adjustments can be made in locating the support members 132*a*, 132*b* relative to the cap body 124.

Figure 3:
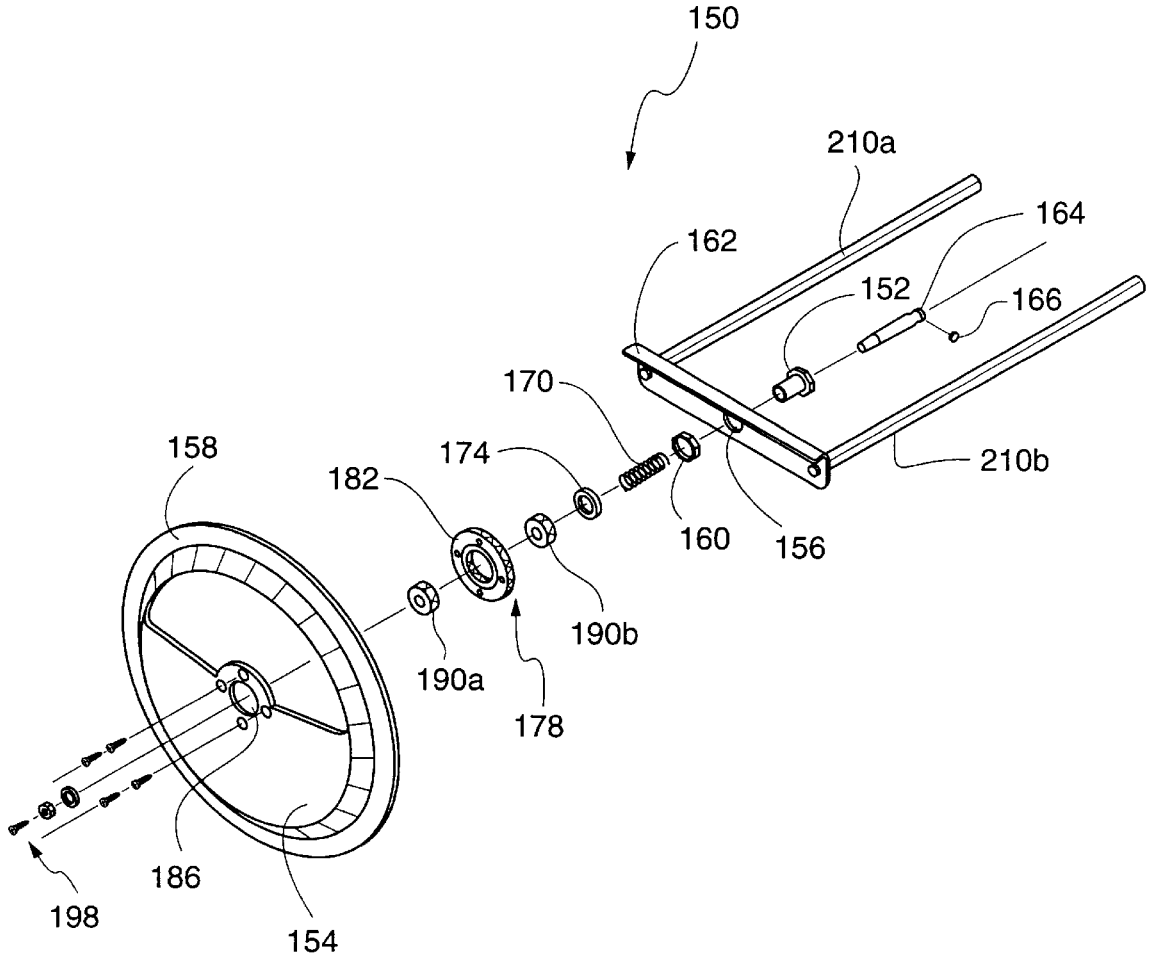
FIG. 3 is an exploded view of the tensioning assembly illustrating the adjusting rods and locking nuts, as well as the disk spring.
Figure 4:
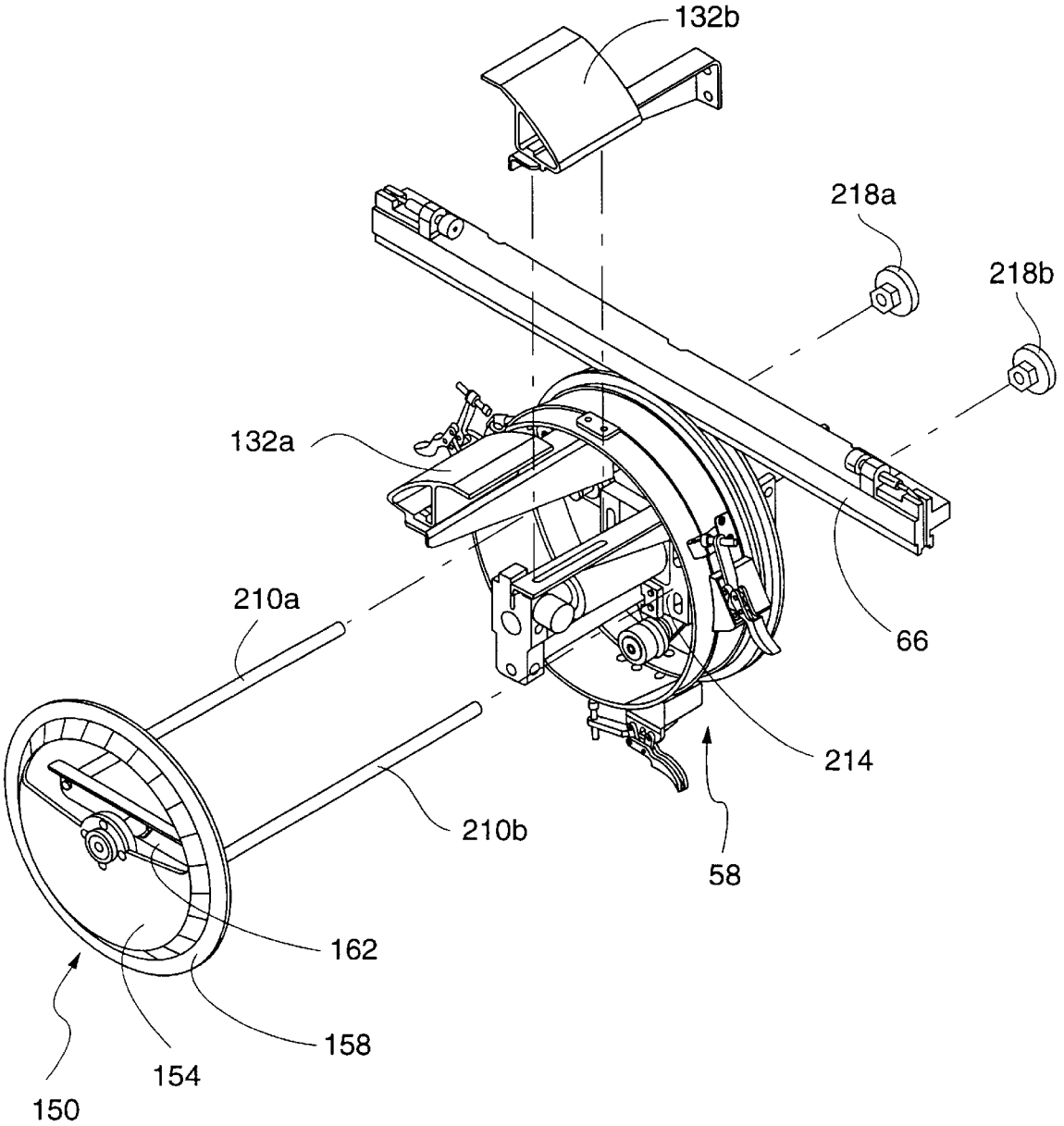
FIG. 4 is an exploded view illustrating the tensioning assembly and the drive apparatus, with one of the support members detached from the drive apparatus.
Figure 5:
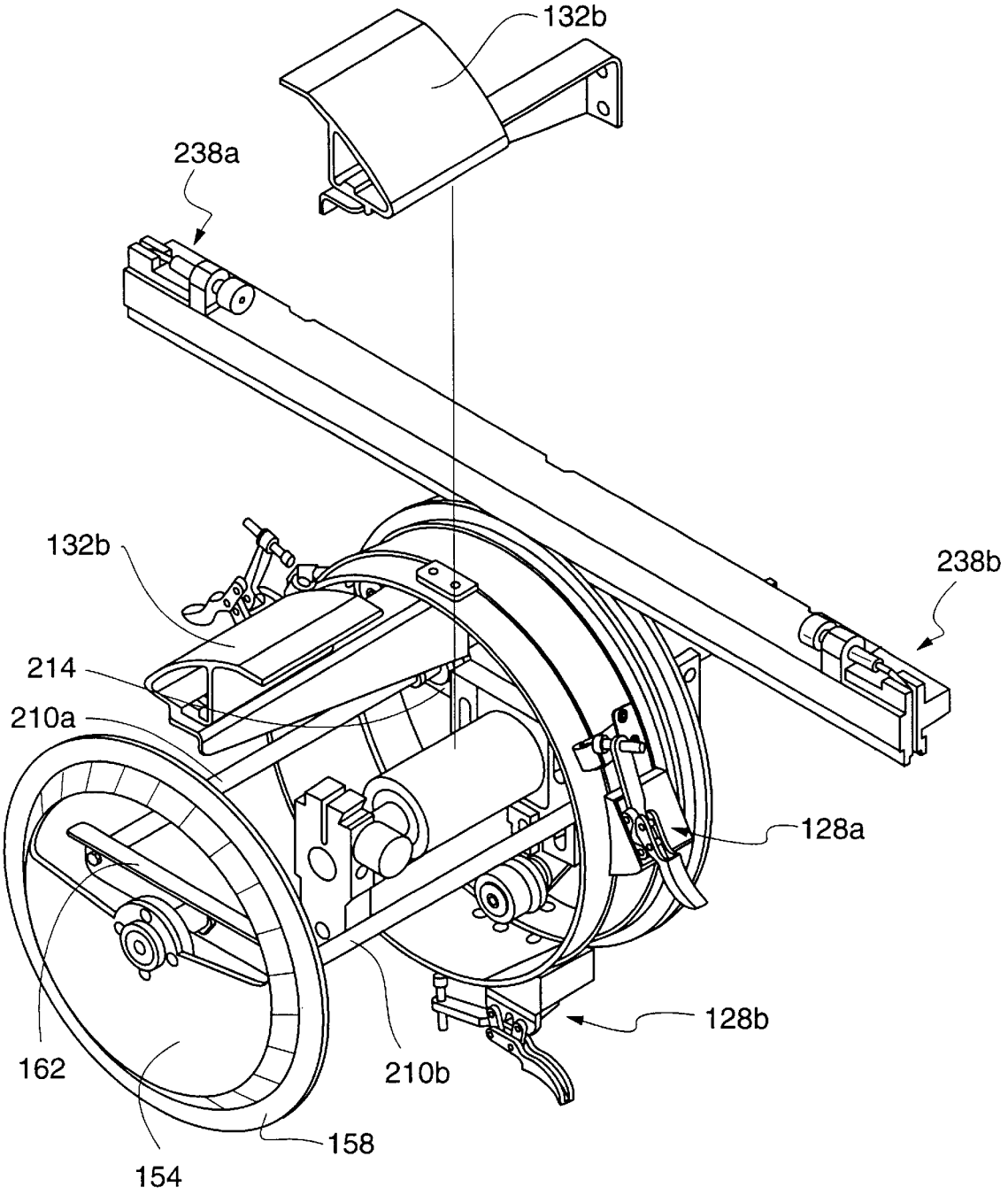
FIG. 5 is a perspective view of the tensioning assembly attached to the drive apparatus with one of the support members detached.

With reference to FIGS. 3–5, an important mechanism of the present invention is illustrated. In particular, a tensioning assembly 150 is shown for providing additional rigidity or stiffness to sections of the cap 54. In that regard, it is frequently desirable to be able to embroider at or along sections of the cap body 124 between the front of the cap 54 at the visor 116 to the back of the cap 54. To embroider properly along these sections of the cap 54, more uniformity and equality of tension needs to be applied around the cap. Prior art systems and devices do not incorporate such additional rigidity and equality of tension. Consequently, there are often undulations of a size present in a cap when it is stitched that detract from a high-quality embroidered pattern. More specifically, because of the lack of rigidity or stiffness along certain sections of the cap 54, the embroidered pattern cannot be stitched to the same relative quality as the embroidered stitching found, for example, on the front of the cap body 124. Typically the front of the cap body 124 is sufficiently stiff or rigid to enable a pattern of resulting high quality to be stitched thereon. On the other hand, prior art mechanisms result in a relatively loose and insufficiently rigid sections of the cap body 124 along its cylindrical section between the front and back of the cap 54. The tensioning assembly 150 overcomes such drawbacks in applying substantially uniform or equal tension to the cap 54 at all desired locations of the cap 54, unlike the prior art.

As seen in FIG. 3, the tensioning assembly 150 includes a tensioning disk 154 having an outer periphery or rim 158. The tensioning disk 154 is joined to an L-shaped bracket 162 using a guide bearing 152 that is located through a hole 156 in the bracket 162. A nut 160 secures the guide bearing 152 to the bracket 162. A shaft 164 is received through the guide bearing 152 and the end of the shaft 164 located at the bracket 162 is surrounded by a locking element 166. A compression spring 170 is disposed adjacent to the nut 160 and surrounds portions of the shaft 164 that extend through the nut 160. The spring 170 loads the tensioning disk 154 to permit movement of the combination of the tensioning inward/outward disk 154 and the shaft 164 relative to the bracket 162 through the bracket hole 154. A washer 174 contains further expansion of the disk spring 170 at the back of the tensioning disk 154. The washer 174 is positioned about the shaft 170 adjacent to a bearing assembly 178. The bearing assembly 178 includes a disk attachment element 182, which is joined to the back of the tensioning disk 154 at its opening 186 in the center thereof. The bearing assembly 178 also includes two bearings 190*a*, 190*b* to facilitate rotation of the tensioning disk 154 relative to the shaft 164. A fastener assembly 198 is used to secure the shaft 164 to the bearing assembly 178.

The tensioning assembly 150 further includes first and second adjusting rods 210*a*, 210*b*, which also have one of their ends affixed to the bracket 162. With reference to FIGS. 4 and 5, the adjusting rods 210*a*, 210*b* are held to a drive frame or base 214 using locking fasteners or nuts 218*a*, 218*b*. That is, the ends of the adjusting rods 210*a*, 210*b*, opposite those connected to the bracket 162, are received through holes in the drive frame 214 and held in position using these locking fasteners 218*a*, 218*b*. The position of each of these two adjusting rods 210*a*, 210*b* can vary relative to the drive frame 214. Consequently, the position of the tensioning disk 154 can be varied in a direction along the length of these two adjusting rods 210*a*, 210*b*. This adjustment is necessary for different size caps. The height of the body or cylindrical portion 124 of the cap can vary by some distance. It is important that the additional tension applied to the cap by the tensioning assembly 150 be located at or very near the crown 222 of the cap 54. Given the position of the cap 54 on the cap frame assembly 100 as illustrated in FIG. 2, a cap 54 having a greater height (high crown cap), based on the cap body 124, would require movement of the adjusting rods 210*a*, 210*b* in an outward direction away from the computerized embroidery machine 24. This adjustment suitably positions a different sized cap since the cap 54 is always secured to the cap frame assembly 100 and the cap frame assembly 100 is always secured to the drive cylinder 78 at the same position, regardless of cap 54 size. For minor height variations among caps 54, the disk spring 170 compensates in providing the desired equal or uniform tension.

The present invention also includes a cable adjustment assembly 230, as best illustrated in FIGS. 2 and 6. The cable adjustment assembly 230 maintains the proper and same tension in the cable 70. Over time and due to significant use of the cable 70 in connection with causing rotation of the drive cylinder 78, the cable 70 tends to decrease in tension application due to lengthening or stretching thereof. Such a change in the length of the cable 70 can lead to inaccurate positioning of the cap 54 relative to the needles 40, due to inaccurate movement of the drive cylinder 78 as a result of the difference in length of the cable 70. To overcome this potential problem, the opposite ends of the cable 70 are connected to cable terminals 234*a,* 234*b*. The cable adjustment assembly 230 also includes guide members 238*a*, 238*b* for receiving their respective cable terminals 234*a*, 234*b*. Each of the two guide members 238*a*, 238*b* has a foot member 242*a*, 242*b* and a base 246*a,* 246*b*. Each of the two foot members 242*a*, 242*b* has a hole through which one of the ends of the cable 70 is received for connection to its respective cable terminals 234*a,* 234*b*. A terminal tension nut 236*a*, 236*b* is joined to a respective cable terminal 234*a*, 234*b*. Disposed between the respective foot members 252*a*, 252*b* and the terminal tension nuts 236*a*, s36*b* of the cable pins 234*a*, 234*b* respectively, are cable springs 252*a*, 252*b*, respectively, which are disposed about body portions of the respective cable terminals 234*a*, 234*b*.

When establishing or setting up the cable 70 and the desired tension for rotating the drive cylinder 78, the cable springs 252*a*, 252*b* are selected for providing the desired force to the cable terminals 234*a*, 234*b*. In the event that the cable 70 should lengthen or stretch over time, the cable springs 252*a*, 252*b* would tend to expand or un-compress thereby forcing the cable terminals 234*a*, 234*b* to move a short distance further away from their respective foot members 242*a*, 242*b*, thereby overcoming the stretching of the cable and maintaining the desired cable tension for accurate rotational movement of the drive cylinder 78. Each of the guide members 238*a*, 238*b* also includes a guide groove member 256*a*, 256*b*, respectively, with each having a guide groove for receiving cable 70 portions that are in alignment with the drive beam groove 74.

Figure 7:
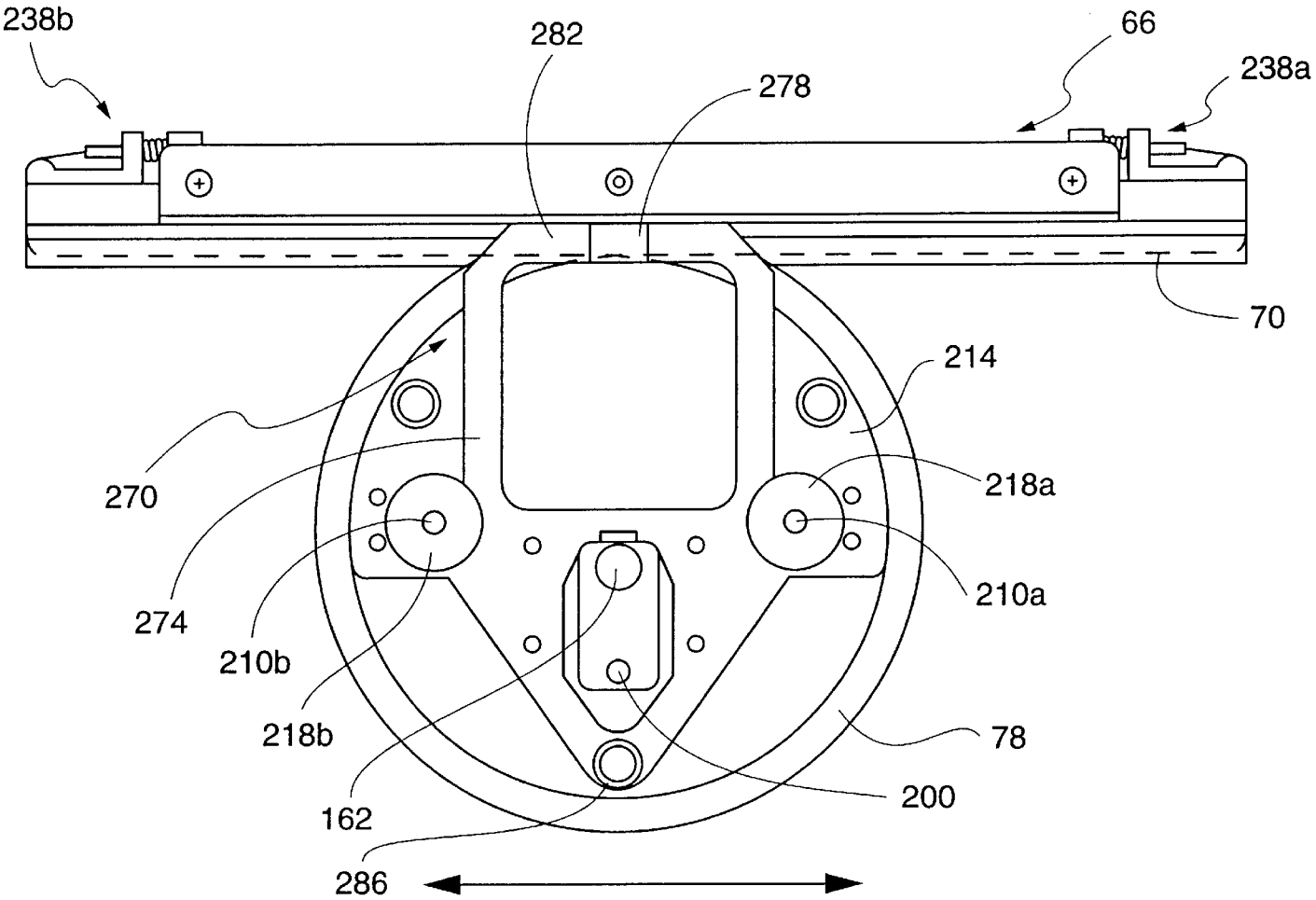
FIG. 7 is a rear view of the drive apparatus illustrating the holder assembly in a first position of the drive beam relative to the cylinder drive.
Figure 8:
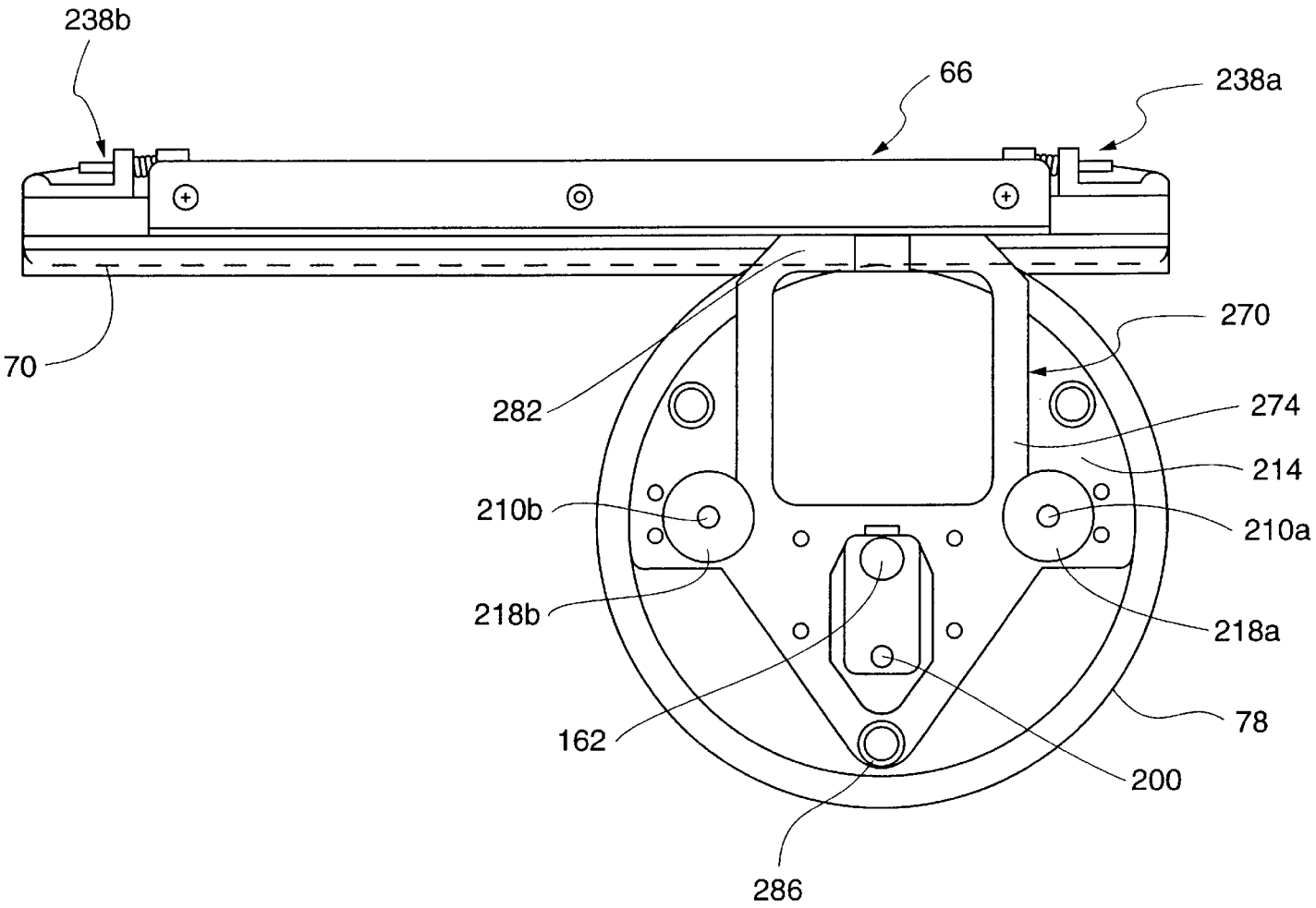
FIG. 8 is a view similar to FIG. 7 but showing the drive beam being suitably held using the holder assembly at a different position relative to the cylinder drive.
Figure 9:
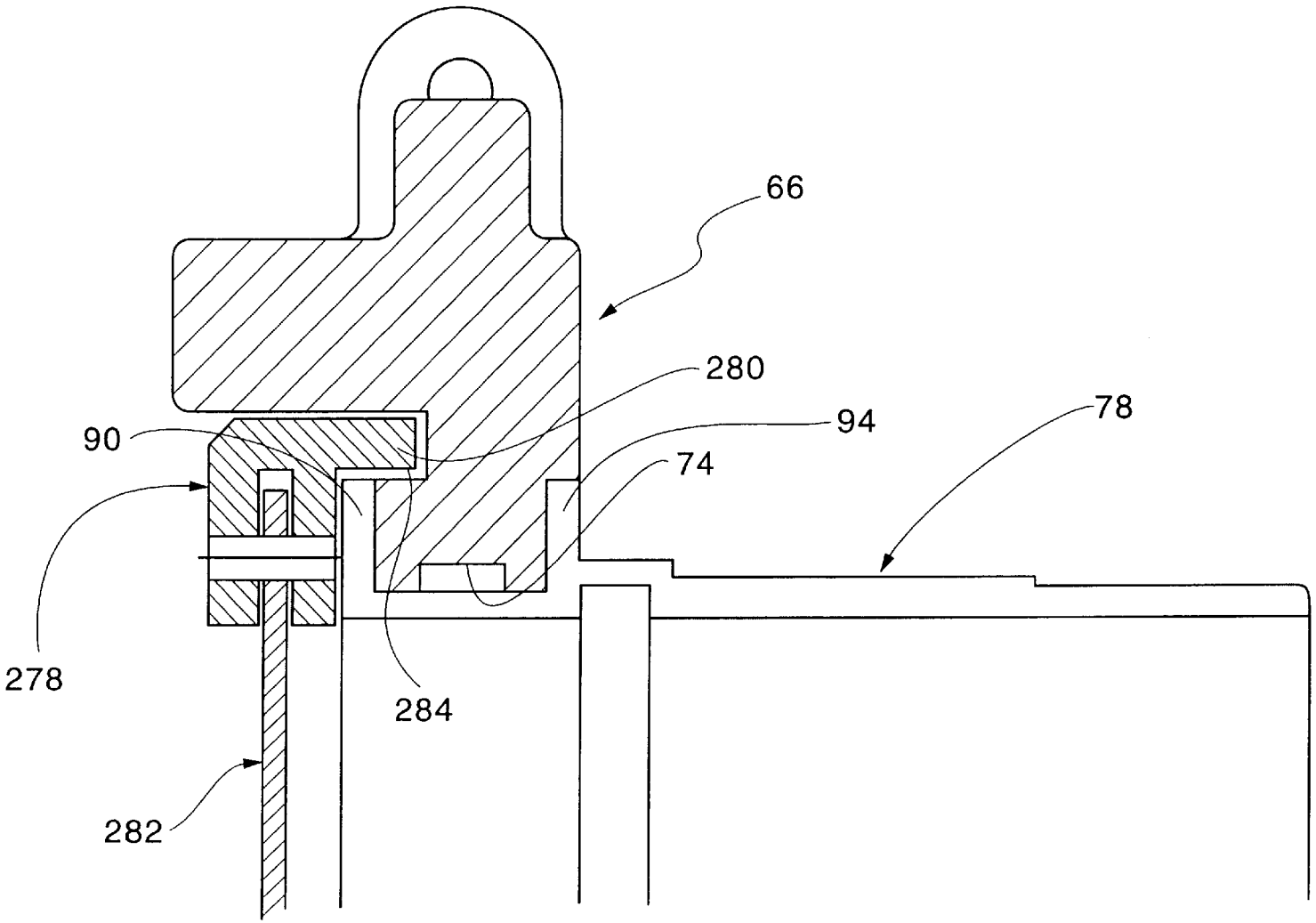
FIG. 9 is an enlarged, fragmentary cross-sectional view illustrating the clip coupled to the drive beam.

Regarding the holding of the drive beam 66 during movement of the drive beam 66 in the X direction, a holder assembly 270 is provided, as illustrated in FIGS. 7–9. The holder assembly 270 is useful in desirably locating or guiding the drive beam 66 during its movement while it is held in the channel 82. The holder assembly 270 includes a bracket 274 that is connected to the drive frame 214. A generally L-shaped clip 278 is connected to the lateral leg 282 of the bracket 274. As best seen in FIG. 9, when the drive beam 66 bottom section 86 is located in the channel 82, the arm 280 of the clip 278 is received in an elongated recess 284 formed in the drive beam 66.

When the drive cylinder 78 is caused to rotate by movement of the drive beam 66 in the X direction, the drive cylinder 78 rotates relative to the drive frame 214 using one or more rollers 286 (FIG. 2). As the drive cylinder 78 rotates, a roller track 290 (FIG. 2), that is an integral part of the drive cylinder 78, rotates relative to the rollers 286. During this movement, the arm 280 guides the drive beam 66, with the clip 278 including its arm 280 remaining stationary. The holder assembly 270 has particular utility when the drive apparatus 58, together with the tensioning assembly 150, are detached from the computerized embroidery machine 24. When this detachment or separation exists, the drive beam 66 is held within the channel 82 and maintains a substantially straight or aligned position relative to the drive cylinder 78, despite the relative movement between the holder assembly 270 and the drive beam 66. This function advantageously avoids unwanted twisting, turning, flopping and/or disengagement of the drive beam bottom or insert section 86 from the channel 82. This facilitates handling and carrying of the cap embroidery apparatus 50.

With respect to the operation of the cap embroidery apparatus 50, its operation in conjunction with the tensioning assembly 150 is next discussed. The drive apparatus 58 and the tensioning assembly 150 are joined to the computerized embroidery machine 24. The position of the tensioning disk 154 is adjusted, depending upon the height of the cap body 124 of the cap 54 that is to be embroidered. Typically, a number of caps are to be embroidered, with each having the same, or substantially the same, height. In connection with this discussion, it will be assumed that the position of the tensioning assembly 150 relative to the drive apparatus 58 has been determined and is now properly set. The next cap 54 to be embroidered is attached to the cap frame assembly 100 as previously noted. The cap frame assembly 100 with cap 54 is then placed over the tensioning disk 154 and moved towards the drive cylinder 78. Adjacent to the position where the cap frame assembly 100 is to be secured to the drive cylinder 78, the cap 54 adjacent its crown 222 contacts the rim 158 of the tensioning disk 154 and causes the tensioning disk 154 to move inwardly against the force of the disk spring 170. With the cap frame assembly 100 in position to be secured to the clamp assemblies 128*a*, 128*b*, the tensioning disk 154, under force of the disk spring 170, has moved outwardly to contact the cap 54 adjacent its crown 222 and thereby provide additional tension to the cap body 124 between the front of the cap 54 at the visor 116 thereof and the back of the cap 54. This additional tension removes undulations or creases that would otherwise be present in the cap body 124 and, in so doing, provides a uniform rigidity to the cap fabric that is comparable to the front of the cap 54. The cap 54 is now ready to be embroidered using the computerized embroidery machine 24 under control of computer software that incorporates a particular embroidery pattern that is to be stitched. In that regard, this computer program causes the carriage assembly 28 to move in X and Y directions relative to the sewing head 36 and the needles 40, as the needles 40 with thread move vertically up and down to stitch the pattern at the desired locations on the cap body 124, such as along the cylindrical section of the cap 54 between the front of the cap 54 and the back thereof. Movement of the cap 54 and the cap frame assembly 100 is accomplished by the previously described rotation of the drive cylinder 78 to which they are connected, due to movement of the drive beam 66 in the X direction. Simultaneously, based on the cap engagement with the tensioning disk 154, the tensioning disk 154 also rotates in the same direction as the cap 54. Movement of the carriage assembly in the Y direction does not involve rotation of the drive cylinder 78. Consequently, neither the cap 54 nor the tensioning disk 154 rotate during movement of the carriage assembly 24 solely in the Y direction. After numerous X and Y carriage assembly movements, the cap body 124 has the desired embroidery pattern and the operation of the computerized embroidery machine 24, with accompanying drive apparatus 58, tensioning assembly 150, cap frame assembly 100 and cap 54, is completed and another cap 54 can then be embroidered.

The foregoing description of the invention has been presented for purposes of illustration and description. Further, the description is not intended to limit the invention to the form disclosed herein. Consequently, variation and modification commensurate with the above teachings, within the skill and knowledge of the art, are within the scope of the present invention. The embodiment described hereinabove is further intended to explain the best mode presently known of practicing the invention and to enable others skilled in the art to utilize the invention in such, or in other embodiments, and with the various modifications required by their particular applications or uses of the invention. It is intended that the appended claims be construed to include alternative embodiments to the extent permitted by the prior art.

What is claimed is:

1. A method for stitching fabric using a computerized machine, comprising:

locating fabric on a drive apparatus;

changing rigidity of at least a first section of the fabric using a tensioning assembly having a movable member; and stitching a desired pattern on the fabric first section using the computerized machine while said movable member rotates, wherein said drive apparatus includes a cable for translating linear movement to rotational movement and said method further includes controlling tension of said cable to reduce errors in positioning of the fabric when it is being stitched to provide the desired pattern.

2. A method for stitching a cap that includes a crown, a body having a back and a visor that extends from the cap at the front thereof, comprising:

locating the cap on a drive apparatus relative to a computerized machine for stitching the cap; and increasing tension of at least a first section of the cap body disposed between the visor and the back of the cap using a tensioning assembly, wherein said drive apparatus includes a tensioning disk and said tensioning disk moves inwardly and outwardly in connection with engaging the cap adjacent the crown when said increasing step is performed.

3. A method, as claimed in claim 2, wherein:

said causing step includes using a spring force in moving said tensioning disk inwardly and outwardly.

4. A method for stitching a cap that includes a crown, a body having a back and a visor that extends from the cap at the front thereof, comprising:

locating the cap on a drive apparatus relative to a computerized machine for stitching the cap;

increasing tension of at least a first section of the cap body disposed between the visor and the back of the cap using a tensioning assembly; and adjusting a position of said tensioning assembly relative to said drive apparatus depending on a size of the cap.

5. A method for stitching a cap that includes a crown, a body having a back and a visor that extends from the cap at the front thereof, comprising:

locating the cap on a drive apparatus relative to a computerized machine for stitching the cap; and increasing tension of at least a first section of the cap body disposed between the visor and the back of the cap using a tensioning assembly, wherein said drive apparatus includes a cable for translating linear movement to rotational movement and said method further includes controlling tension of said cable to reduce errors in positioning of the cap when it is being stitched to provide a desired pattern.

6. A method for stitching a cap that includes a crown, a body having a back and a visor that extends from the cap at the front thereof, comprising:

locating the cap on a drive apparatus relative to a computerized machine for stitching the cap; and increasing tension of at least a first section of the cap body disposed between the visor and the back of the cap using a tensioning assembly, wherein said drive apparatus includes a drive beam and a drive cylinder having a channel and said method further includes holding said drive beam in said channel using a clip.

7. An apparatus for stitching fabric that is connected to a computerized machine, comprising:

means for positioning the fabric for stitching relative to the computerized machine, said means for positioning including a drive apparatus with a cable and cable adjusting means operatively connected to said cable for controlling tension thereof; and a tensioning assembly connected to said means for positioning for increasing tension applied to at least a first section of the fabric, wherein said tensioning assembly includes a movable member that rotates during stitching of the fabric and wherein said means for positioning includes a drive apparatus with a cable and cable adjusting means operatively connected to said cable for controlling tension thereof.

8. An apparatus, as claimed in claim 7, wherein:

said cable adjusting means includes at least a first spring for increasing tension to said cable when said cable increases in length.

9. An apparatus for stitching fabric that is connected to a computerized machine, comprising:

means for positioning the fabric for stitching relative to the computerized machine, said means for positioning including a drive apparatus with a cable and cable adjusting means operatively connected to said cable for controlling tension thereof; and a tensioning assembly connected to said means for positioning for increasing tension applied to at least a first section of the fabric, wherein said tensioning assembly includes a movable member that rotates during stitching of the fabric, wherein said means for positioning includes a drive beam and a drive apparatus and said apparatus further includes a holding assembly for maintaining a desired engagement between said drive beam and said drive apparatus and wherein said drive apparatus further includes a cable and said holding assembly includes a clip for engaging said drive beam.

10. An apparatus for stitching fabric that is connected to a computerized machine, comprising:

means for positioning the fabric for stitching relative to the computerized machine, said means for positioning including a drive apparatus with a cable and cable adjusting means operatively connected to said cable for controlling tension thereof; and a tensioning assembly connected to said means for positioning for increasing tension applied to at least a first section of the fabric, wherein said tensioning assembly includes a movable member that rotates during stitching of the fabric and wherein said tensioning assembly movable member is connected to at least a first adjustable rod having a position dependent on a size of the fabric being stitched.

11. An apparatus for stitching fabric that is connected to a computerized machine, comprising:

means for positioning the fabric for stitching relative to the computerized machine; and a tensioning assembly connected to said means for positioning for increasing tension applied to at least a first section of the fabric, wherein said tensioning assembly includes a movable member that rotates during stitching of the fabric, said tensioning assembly including means for permitting said movable member to move inwardly and outwardly relative to said means for positioning.

12. An apparatus for stitching fabric that is connected to a computerized machine, comprising:

means for positioning the fabric for stitching relative to the computerized machine, said means for positioning including a drive apparatus with a cable and cable adjusting means operatively connected to said cable for controlling tension thereof; and a tensioning assembly connected to said means for positioning for increasing tension applied to at least a first section of the fabric, wherein said tensioning assembly includes a movable member that rotates during stitching of the fabric, wherein said tensioning assembly movable member is movable inwardly and outwardly relative to said means for positioning and wherein said tensioning assembly includes a spring and said movable member includes a tensioning disk and in which said spring permits said tensioning disk to move inwardly and outwardly.

13. An apparatus, as claimed in claim 11, wherein:

said means for permitting include a spring.

14. An apparatus, as claimed in claim 11, wherein:

said movable member includes a tensioning disk.

* * * * *